US008647505B2

(12) United States Patent
Hoffmann

(10) Patent No.: US 8,647,505 B2
(45) Date of Patent: Feb. 11, 2014

(54) SCREEN CLAMP WITH INTEGRATED CENTER FEED

(75) Inventor: Jeffrey R. Hoffmann, Fairfield, OH (US)

(73) Assignee: The Western States Machine Company, Hamilton, OH (US)

( * ) Notice: Subject to any disclaimer, the term of this patent is extended or adjusted under 35 U.S.C. 154(b) by 409 days.

(21) Appl. No.: 13/168,216

(22) Filed: Jun. 24, 2011

(65) Prior Publication Data

US 2012/0329630 A1 Dec. 27, 2012

(51) Int. Cl.

| | |
|---|---|
| ***B04B 3/00*** | (2006.01) |
| ***B04B 7/16*** | (2006.01) |
| ***B04B 11/02*** | (2006.01) |

(52) U.S. Cl.

USPC ..... 210/232; 210/380.1; 210/497.01; 127/19

(58) Field of Classification Search

USPC ..... 210/232, 380.1, 497.01; 127/19

See application file for complete search history.

(56) References Cited

U.S. PATENT DOCUMENTS

| | | | |
|---|---|---|---|
| 3,238,063 | A | 3/1966 | Steele |
| 3,393,805 | A | 7/1968 | Laven |
| 3,837,913 | A | 9/1974 | Hilldbrand et al. |
| 3,845,788 | A | 11/1974 | Laven |
| 3,970,470 | A | 7/1976 | Trojan et al. |
| 5,209,856 | A | 5/1993 | Cuel et al. |
| 7,208,048 | B2 | 4/2007 | Eastaughffe |

FOREIGN PATENT DOCUMENTS

| | | |
|---|---|---|
| WO | WO95/21697 | 8/1995 |
| WO | WO9702094 | 1/1997 |
| WO | WO03033163 | 4/2003 |
| WO | WO2010130827 | 11/2010 |
| WO | WO2010130828 | 11/2010 |

OTHER PUBLICATIONS

International Search Report and Written Opinion Dated Mar. 5, 2013, pertaining to International Application No. PCT/US2012/043556.

*Primary Examiner* — David A Reifsnyder

(74) *Attorney, Agent, or Firm* — Dinsmore & Shohl LLP

(57) ABSTRACT

A screen clamp with integrated center feed is disclosed. The screen clamp may be rotatably mounted in a continuous centrifuge. The screen clamp may comprise: a feed cone having a base and sidewall, wherein a center of the base has a feed opening and the sidewall has one or more discharge openings; and an outer flange attached to and extending along a bottom edge of the feed cone, wherein the outer flange is configured to secure a basket filtering screen of a continuous centrifuge to a basket. The screen clamp may be configured to direct a massecuite feed entering the feed opening through the one or more discharge openings and onto the basket filtering screen. The screen clamp may also comprise a weir.

14 Claims, 7 Drawing Sheets

SCREEN CLAMP WITH INTEGRATED CENTER FEED

BACKGROUND

The processing of sugar to produce refined sugar can include several steps, for example, an evaporation step followed by a crystallization process. During an evaporation step, sugar liquor may be concentrated to sugar syrup. Sugar crystals may also evaporate out of solution. The sugar syrup may then be sent to crystallizers for further processing to produce sugar crystals. The resulting mixture from the crystallization step is called massecuite, which may be composed of sugar crystals in a thick, viscous liquid (molasses). The massecuite may also contain dissolved sugar and organic and inorganic impurities. To isolate the sugar crystals, the massecuite may be processed through a continuous centrifuge to separate the sugar crystals from the liquid molasses.

Two ways of introducing a feed to a continuous centrifuge are believed to exist—a side feed arrangement where massecuite is fed to the bottom of a rotating conical basket down the outside of a fixed metal probe and a center feed arrangement where the feed is fed to the center of the rotating conical basket. Particularly, in a massecuite feed, it may be important to introduce the feed in such a way so as to avoid any damage to the sugar crystals. It may also be important to introduce the massecuite feed in such a way to achieve proper separation of the sugar crystals from the molasses.

Accordingly, there is a continual need for improved centrifuge systems, and components therewith, which deliver massecuite to a centrifuge to achieve improved separation with minimal damage of the sugar crystals from the molasses. It is believed that no one prior to the inventor has made or used an invention as described herein.

SUMMARY

The system described herein is a screen clamp with integrated center feed that is designed to direct massecuite into a centrifuge basket for separation. The screen clamp with integrated center feed is also configured to secure the basket filtering screens within the centrifuge basket.

In one example, a screen clamp with integrated center feed is provided. The screen clamp comprises: a) a feed cone having a base and sidewall, wherein a center of the base has a feed opening and the sidewall has one or more discharge openings; and b) an outer flange attached to and extending along a bottom edge of the feed cone, wherein the outer flange is configured to secure a basket filtering screen to a centrifuge basket. The screen clamp may be configured to direct a massecuite feed entering the feed opening through the one or more discharge openings and onto the basket filtering screen. The screen clamp may further comprise a weir.

In another example, a continuous centrifuge comprising a centrifuge housing and a center feed arrangement disposed in the centrifuge housing is disclosed. The center feed arrangement comprises: a basket hub, a basket rotatable around a vertical axis and attached to the basket hub, a basket filtering screen attached to the basket, a screen clamp that fastens the basket filtering screen to the basket, the screen clamp comprising: a feed cone having a base and at least one sidewall extending downwardly from the base, wherein a center of the base comprises at least one feed opening and the bottom of the sidewall comprise one or more discharge openings, and an outer flange attached to and extending along a bottom edge of the feed cone, and a center feed pipe positioned to feed massecuite to the center of rotation of the conical screening basket. The center feed arrangement may be configured to direct a massecuite feed through the feed opening of the screen clamp and through the one or more discharge openings of the screen clamp to the conical screening basket.

Features and benefits of the various embodiments of the present invention will become apparent from the following description, which includes figures and examples of specific embodiments intended to give a broad representation of the invention. Various modifications will be apparent to those skilled in the art from this description and from practice of the invention. The scope is not intended to be limited to the particular forms disclosed and the invention covers all modifications, equivalents and alternatives falling within the spirit and scope of the invention as defined by the claims.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. In the drawings, like numerals represent like elements throughout the several views.

Figure 1:
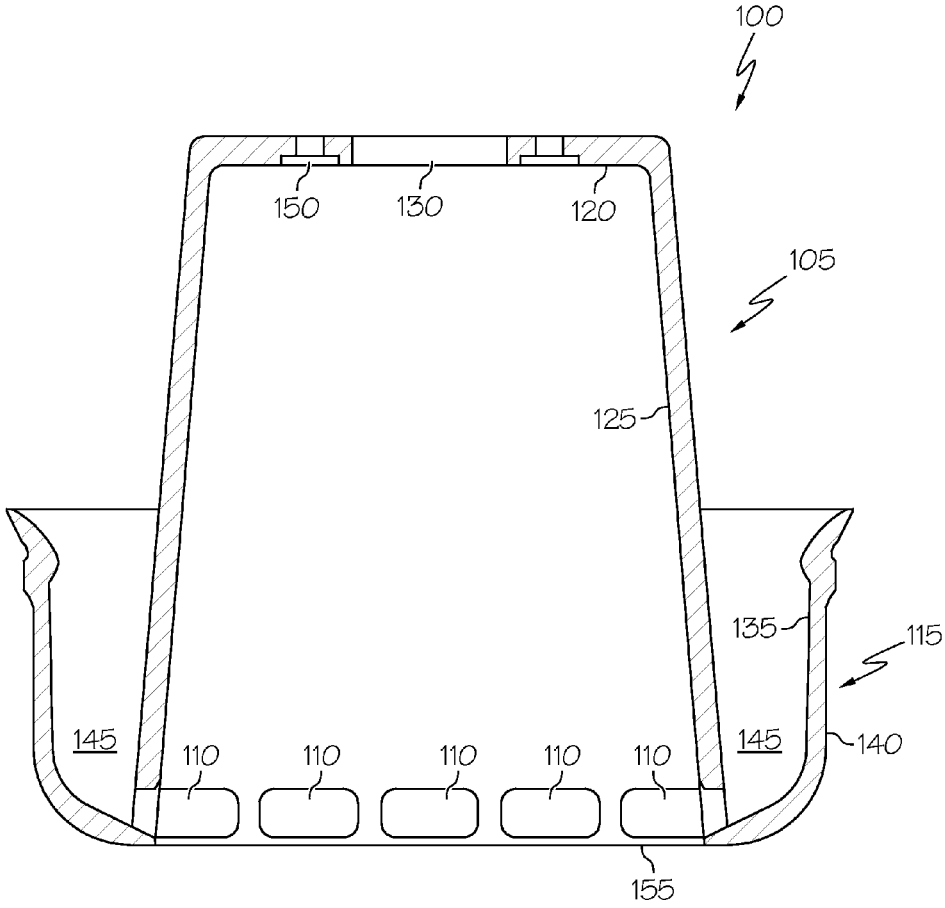
FIG. 1 depicts a side cutaway view of an example screen clamp with integrated center feed.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

Referring to FIG. 1, an exemplary screen clamp with integrated center feed 100 is depicted. The screen clamp with integrated center feed 100 comprises a feed cone 105, one or more discharge openings 110, and a outer flange 115. The feed cone 105 and outer flange 115 may be formed by, for example, a single casting, welded fabrication of the feed cone to the outer flange, or a combination of both casting and fabrication. Of course, other suitable methods of forming the screen clamp with integrated center feed 100 will be apparent to those of ordinary skill in the art in view of the teachings herein.

The feed cone 105 comprises a base 120, which is the uppermost portion of the feed cone 105, and further comprises one or more sidewalls 125 extending downwardly from the base 120. The sidewall 125 may be angled outwardly from the base 120, such that the lower end of the feed cone 105 has a greater diameter than the upper end of the feed cone 105 i.e., the base 120. The lower end of the feed cone 105 is fully open or substantially open in order to be attached over a basket hub 300 as described below. In some examples, the sidewall 125 is angled outwardly from vertical between about 2 degrees and about 12 degrees. In other examples, the sidewall 125 is angled outwardly from vertical between about 4 degrees and about 11 degrees. In further examples, the sidewall 125 is angled outwardly from vertical between about 8 degrees and about 11 degrees. As depicted, the feed cone 105 is frusto-conical in shape. However, the feed cone 105 can take on other suitable shapes and configurations that may be apparent to one skilled in the art in view of the teachings herein. For example, the feed cone 105 may be cylindrical or frusto-pyramidal in shape. Where the feed cone 105 is cylindrical in shape, the sidewall 125 is not angled outwardly from the base 120, and the lower end of the feed cone 105 may have a diameter that is the same as the upper end of the feed cone 105.

The center of base 120 has a feed opening 130. The feed opening 130 is sized to permit massecuite to flow through the opening. The feed opening 130 may also be configured to allow for a massecuite center feed pipe to fit within the feed opening. In some examples, the feed opening 130 may be sized to be from about 3" to about 8". In other examples, the feed opening 130 may be sized to be from about 4" to about 6". The base 120 is depicted in FIG. 1 as circular in shape. Of course, the base 120 can take on other suitable shapes and configurations that may be apparent to one skilled in the art in view of the teachings herein. For example, the base 120 may be triangular, square, pentagon, rectangular, etc.

The outer flange 115 is positioned at the lower end of the feed cone 105 and extends upwardly. The outer flange 115 is attached to and extending along a bottom edge 155 of the feed cone 105. The outer flange 115 has an inner side 135 and an exterior side 140. A channel 145 is formed between the inner side 135 of outer flange 115 and the exterior side of sidewall 125 of feed cone 105.

Figure 2A:
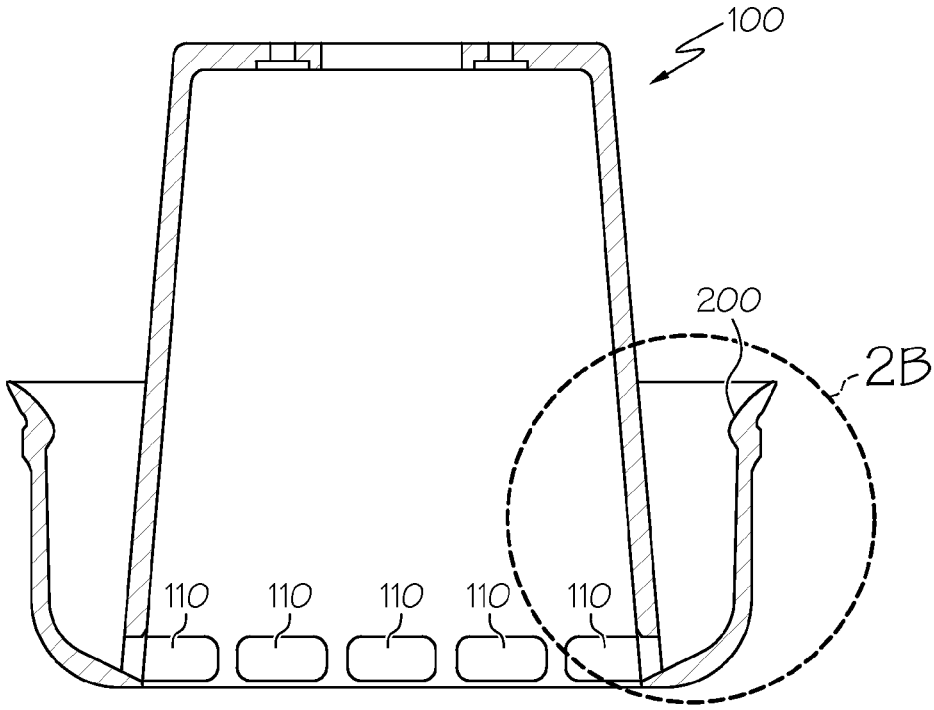
FIGS. 2A & 2B depict a magnified view of a weir on an example screen clamp with integrated center feed.
Figure 2B:
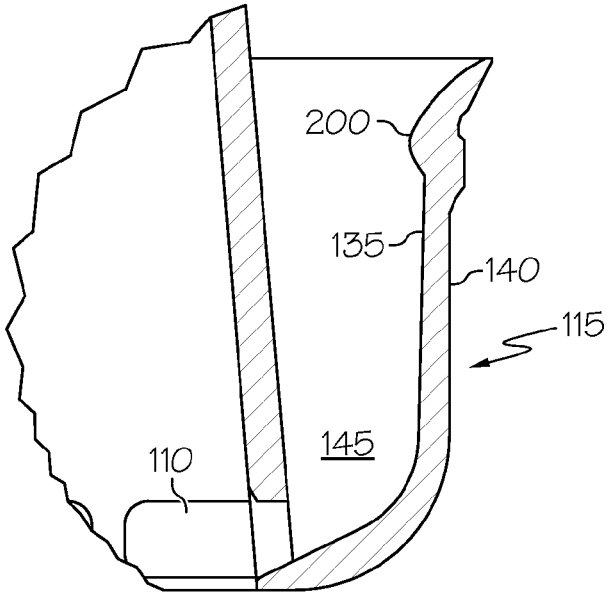

As depicted in FIGS. 2A and 2B, outer flange 115 has an upper weir edge 200, where the weir 200 that is positioned at the top edge of outer flange 115. Without being bound by theory, it is believed that weir 200 may function to force massecuite to pool on the inner side 135 of the outer flange 115 causing the massecuite too spread out and further mix the massecuite feed. In this way, weir 200 may cause the screen clamp 100 to essentially act like a shallow decanting centrifuge, where the weir 200 may cause the massecuite feed to build to a nominal depth before spilling over the top edge of the outer flange 115 and proceeding to the centrifuge basket screens. It is also believed that, weir 200 may act as a dam, trapping solids that may be more dense than the massecuite feed. Examples of solids can include rust scale, welding slag, washers, small fasteners or other pieces of metal, also known as tramp metal, to travel down into the continuous centrifuge. Because of the high gravitational force present when the continuous centrifuge is in operation, these shards of metal can cause severe damage to the delicate centrifuge basket filtering screens. Thus, solids that collect in the channel 145 may be seen and removed by an operator, once the centrifuge basket has stopped rotating without disassembly of the screen clamp 100.

The base 120 may also comprise one or more fastener openings 150 in the base. Without being bound by theory, it is believed that locating the one or more fastener openings 150 in base 120 can make the fasteners used within the one or more fastener openings 150 more accessible as compared to other types of screen clamps. Specifically, some screen clamps use fasteners located in the channel 145 area, which can make the fasteners erode quicker due to contact with the massecuite, make the fasteners less accessible, and make the fasteners harder to remove after contact with the massecuite (a sticky, viscous substance). In some examples, between 4 to 12 fasteners may be used within the one or more fastener openings 150; however, various amounts of fasteners are contemplated.

Figure 3:
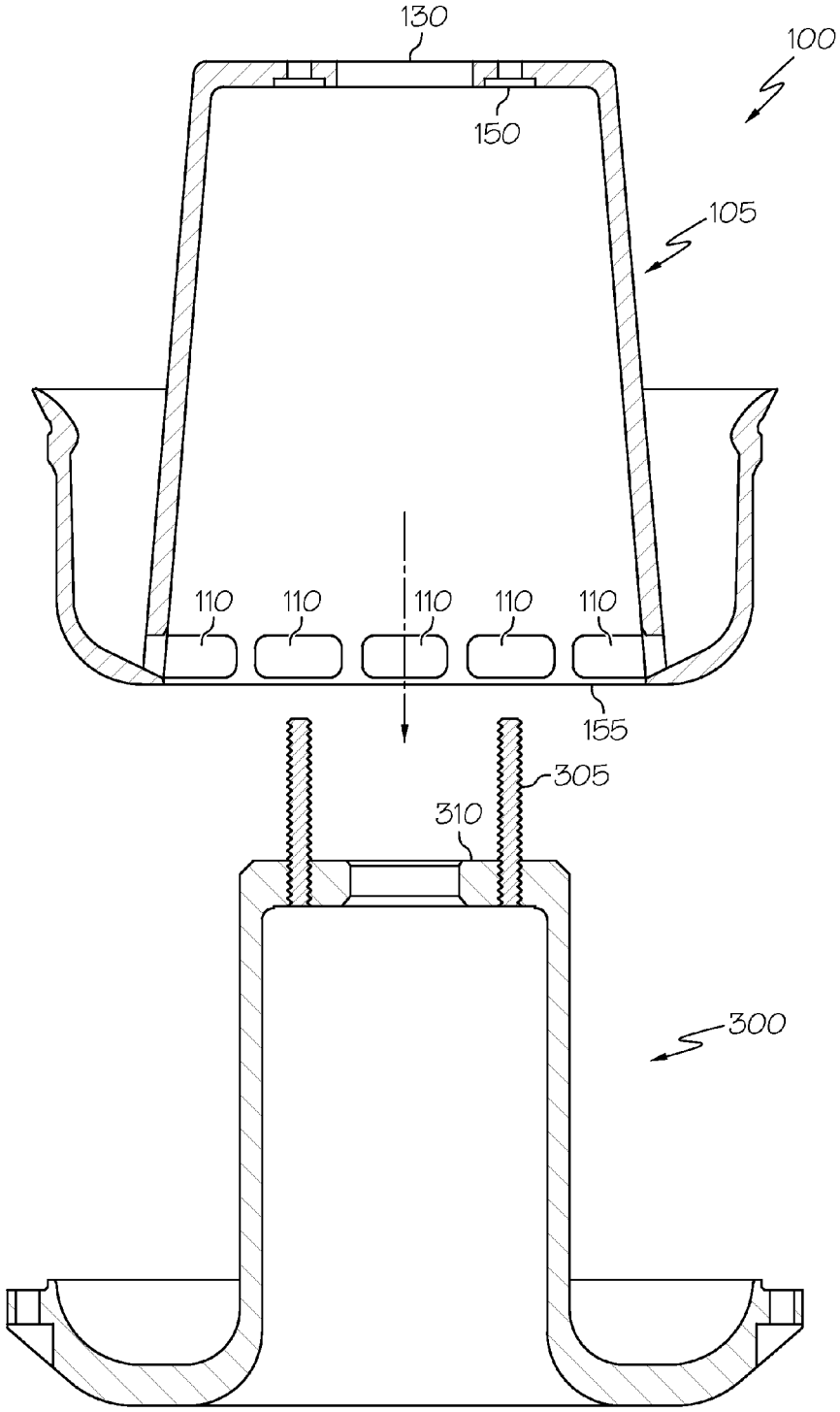
FIG. 3 depicts a side cutaway view of the example screen clamp with integrated center feed of FIG. 1 being mounted on a basket hub.
Figure 4:
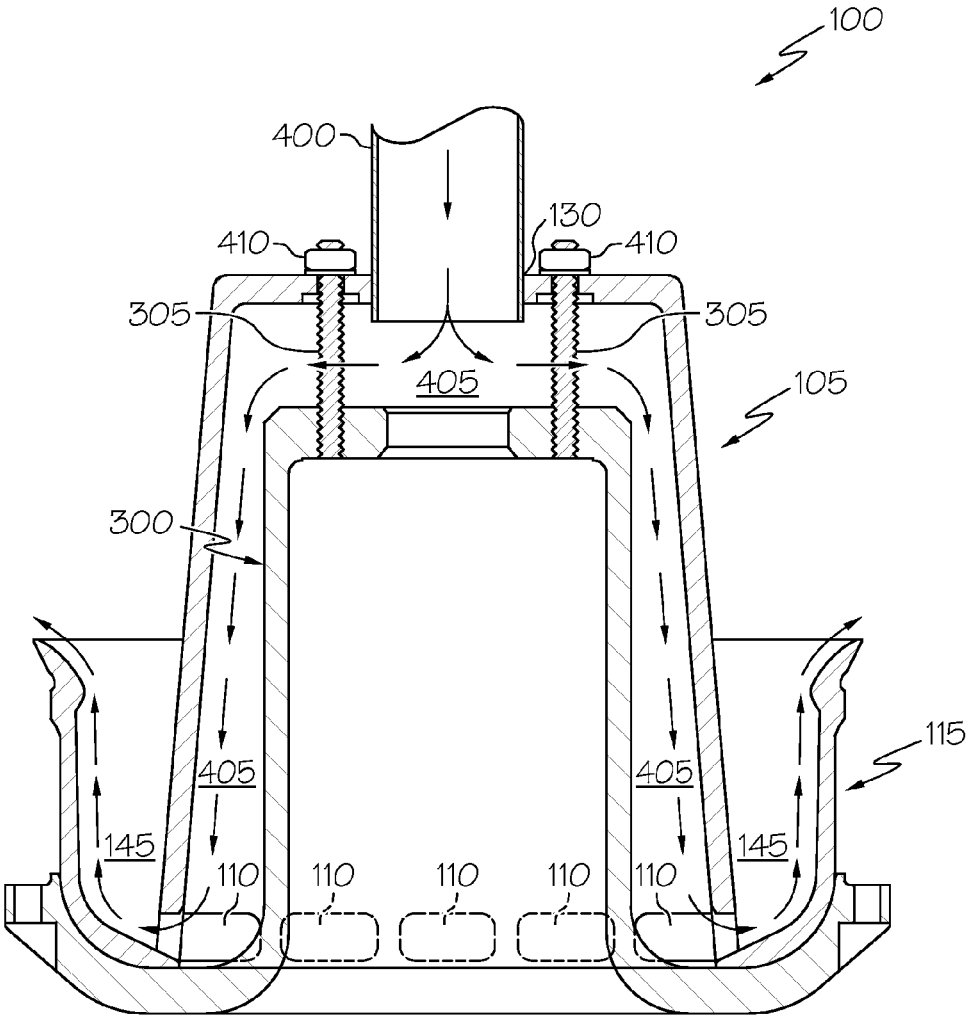
FIG. 4 depicts a side cutaway view of massecuite flowing through the example screen clamp with integrated center feed of FIG. 1 mounted on a basket hub.

As depicted in FIG. 3, fastener openings 150 are configured to allow one or more fasteners fasten the screen clamp 100 to a basket hub 300. In this particular example, basket hub 300 has one or more fastener studs 305 extending from the top edge 310 of basket hub 300. As depicted in FIG. 4, the one or more fastener studs 305 may extend through one or more fastener openings 150 in screen clamp 100 in order to secure the screen clamp 100 to the basket hub 300. One or more nuts 410 are depicted to releasably secure and hold the two parts (the screen clamp 100 and the basket hub 300) together. Of course, other suitable variations for releasably securing the screen clamp 100 to the basket hub 300 will be apparent to one of ordinary skill in the art in view of the teachings herein. For example, a threaded fastener, rivet, push pin may be used to secure the two parts together.

The sidewall 125 also comprises one or more discharge openings 110 configured to allow massecuite flow there-through. The one or more discharge openings 110 are formed along a bottom edge 155 of the feed cone 105. As depicted in FIG. 4, in operation, a vertical centrifuge massecuite center feed pipe 400 is positioned within feed opening 130 of the feed cone 105. As massecuite is flowing through the feed opening 130, the massecuite is directed through the chamber 405 created between the screen clamp 100 and the basket hub 300. The massecuite exits the chamber 405 through the one or more discharge openings 110 and moves through the channel 145. The massecuite ultimately flows over the edge of outer flange 115 and onto the basket screens for separation, which is further described below. The one or more discharge openings 110 may be formed in feed cone 105 by casting, machining, or other suitable ways for forming an opening. The feed cone 105 is configured to direct a massecuite feed entering the feed opening 130 through the one or more discharge openings 110 and into a basket assembly 500 for separation as shown in FIGS. 5A and 5B.

Figure 5A:
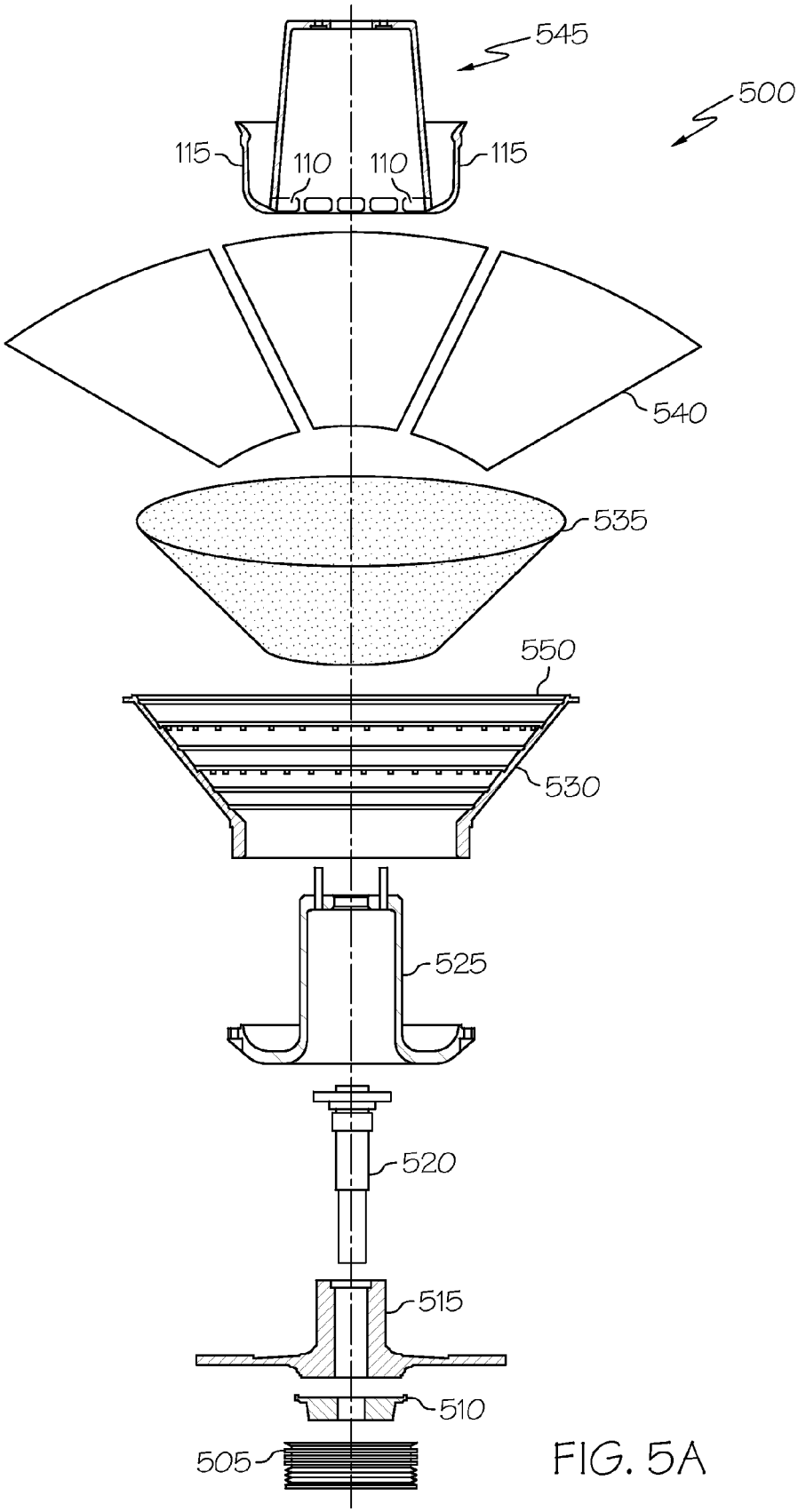
FIGS. 5A and 5B depict an exemplary centrifuge basket assembly using a screen clamp with integrated center feed.
Figure 5B:
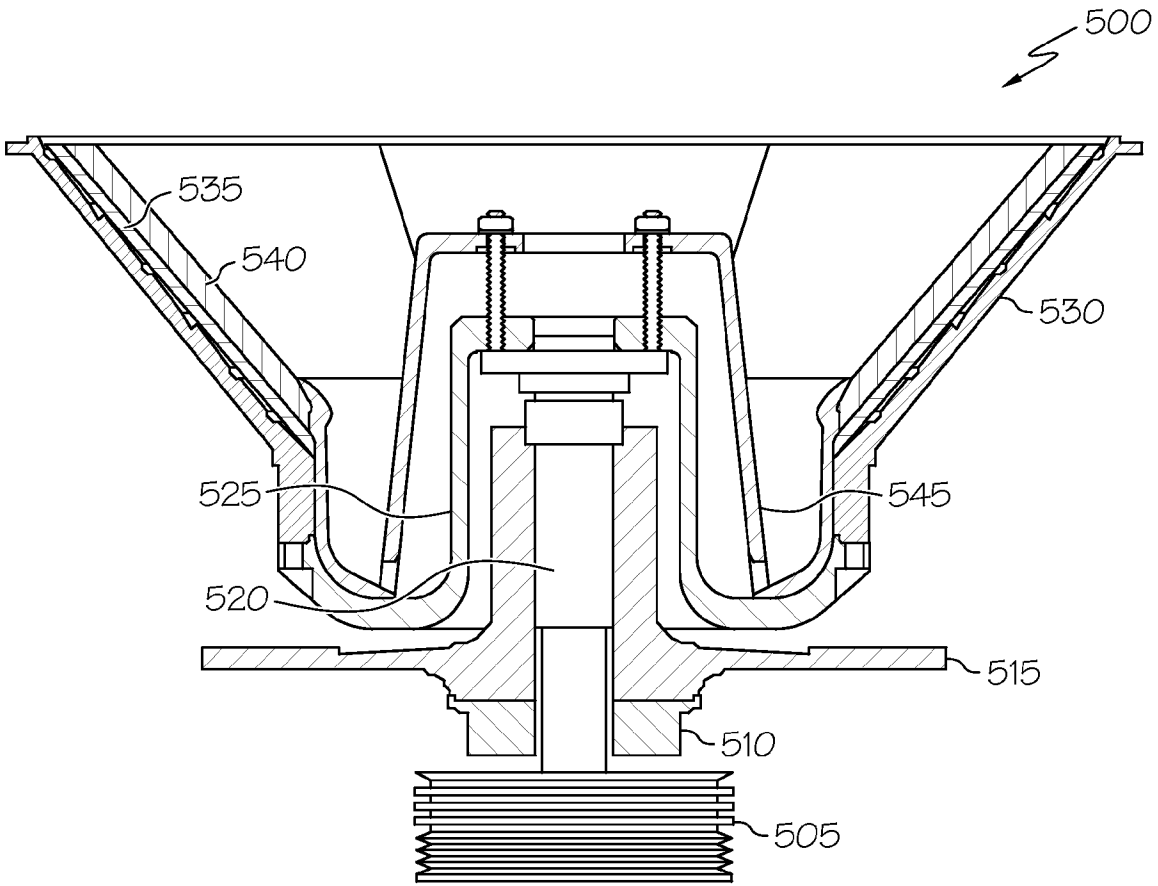

Depicted in FIGS. 5A and 5B is a basket assembly 500. As shown in the exploded view of the basket assembly 500 in FIG. 5A, the basket assembly 500 comprises a pulley 505, a lower seal and grease catch 510, a bearing housing 515, a vertical spindle 520, a basket hub 525, an example basket 530 with grooves and drainage holes, a backing screen 535 having a coarse mesh, top screens 540 having a fine mesh, and a screen clamp with integrated center feed 545. The basket 530 is generally in the shape of a cone. In some examples, the basket 530 may have a vertical angle of between about 20 degrees and 36 degrees. In other examples, the basket 530 may have a vertical angle of between about 24 degrees and 32 degrees.

The screen clamp 545 fits inside the bottom of the conical basket 530 and is attached to basket hub 525. When the screen clamp 545 is in place and secure, it pinches the bottom of the top screens 540 and backing screen 535 (to hole them in place) between the screen clamp 545 and basket 530. Thus, the basket hub 525 and screen clamp 545 secure the basket 530 and basket filtering screens 535, 540 together between the basket hub 525 and screen clamp 545. The screen clamp 545 may rotate within the centrifuge along with the basket assembly 500.

As noted above, massecuite is fed into the center of the screen clamp 545. The massecuite then flows to the bottom of screen clamp 545, through the one or more discharge openings 110, and up and over the outer edge of the outer flange 115. The massecuite then flows onto the basket filtering screens 535, 540. The screens 535, 540 have openings that are sized large enough to allow molasses to pass through, sized small enough to prevent a majority of the sugar crystals from passing through. In some examples, the screen openings are sized so as to prevent at least 60% of the sugar crystals from passing through. In some examples, the screen openings are sized so as to prevent at least 75% of the sugar crystals from passing through. In some examples, the screen openings are sized so as to prevent at least 85% of the sugar crystals from passing through. The top screen 540 may be made from thin (e.g., from about 0.3 mm to about 1.0 mm) chrome plated nickel or laser cut stainless steel. The top screen 540 may be made up of between two and five overlapping segments that are arranged evenly around the inside of the basket 530. As the basket assembly 500 rotates, the high gravitational force causes the sugar crystals to migrate up the top screen 540, while the molasses drains out through the openings in the basket filtering screens 535, 540 and basket 530.

Figure 6:
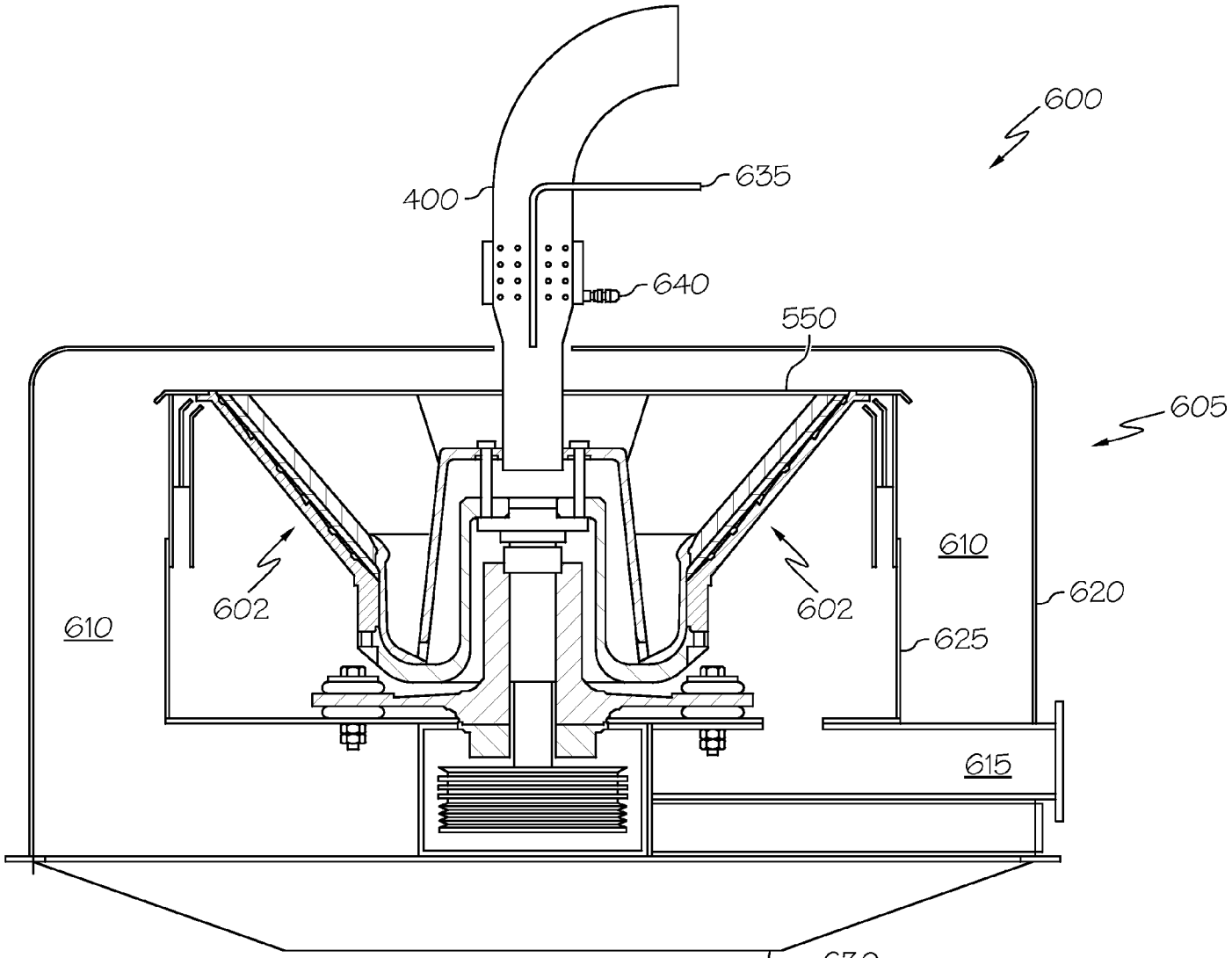
FIG. 6 depicts a side view of an exemplary center centrifuge system using an example screen clamp with integrated center feed.

Referring to FIG. 6, depicted is a continuous centrifuge center feed arrangement as part of a continuous centrifuge system 600, which is used to feed massecuite into the continuous centrifuge system 600 to separate the massecuite into its liquid (molasses) and solid (sugar crystals) components. The feed arrangement comprises: a conical screening basket rotatable 602 around a vertical axis; a vertical centrifuge massecuite center feed pipe 400 positioned to feed massecuite to the center of rotation of the conical screening basket 602; a basket hub 525; and a screen clamp 545. As noted above, the screen clamp 545 comprises: a feed cone 105 having a base 120 and sidewall 125, wherein the center of the base 120 has a feed opening 130 and the sidewall 125 has one or more discharge openings 110, and an outer flange 115 attached to and extending along a bottom edge of the feed cone 105. The screen clamp 545 is configured to secure a portion of a basket filtering screen 535, 540 to a basket 530 and direct a massecuite feed from the feed opening 130 through the one or more discharge openings 110 to the conical screening basket 602.

Also depicted in FIG. 6 is centrifuge 605. The centrifuge 605 comprises a basket assembly 500, a sugar discharge passageway 610, a molasses discharge outlet 615, and a housing 620. The basket assembly 500 is mounted on a vertical spindle 520 within a labyrinth 625. The labyrinth may function to separate the path to sugar discharge outlet 630 from the path to molasses discharge outlet 615. Thus, the labyrinth can essentially keep the molasses from reentering the chamber where the sugar crystals are discharged. The vertical spindle 520 allows for the basket assembly 500 to rotate about a vertical axis. The basket 530 can have an inner circular surface which conically extends in an upward direction to an upper open inlet end 550 of the basket 530. In general, the basket 530 may have various shapes, e.g., cylindrical, conical, frustoconical, etc. The basket 530 can have grooves and drainage holes or may simply be a perforated basket. The basket 530 may use a top (or filtering) screen, which may have a fine mesh for separation of crystals from the molasses. There may also be an intermediate screen, which provides support for the filtering screen and can allow the molasses to flow through it to one of the drainage holes (i.e., perforations) in the basket. The vertical spindle 520 and the basket 530 can be driven at various centrifugal speeds and is operable to separate a homogenous massecuite product into its sugar crystal and liquid molasses components. Basket speed can be affected by the characteristics of the massecuite (e.g., size of the sugar crystals, amount of sugar crystals, viscosity, etc.), centrifuge throughput, etc. For example, the basket 530 and vertical spindle 520 may be driven from about 800 rpm to about 2200 rpm to separate a homogeneous massecuite product into its sugar crystal and liquid molasses components.

The sugar discharge passageway 610 is the passage created between the labyrinth 625 and the housing 620 of centrifuge 605. The separated sugar crystals fall through sugar discharge passageway 610 and exit out of sugar discharge outlet 630. There may be one or more sugar discharge outlets associated with centrifuge 605. The molasses discharge outlet 615 may be disposed at a lower end of the basket assembly 500. The molasses separated from the sugar crystals may be discharged through the molasses discharge outlet 615. There may be one or more molasses discharge outlets associated with centrifuge 605.

In operation, as shown in FIGS. 5A, 5B & 6, the walls of basket assembly 500 may be angled such that the sugar crystals and liquid molasses can migrate up the basket assembly wall as the centrifuge rotates. The liquid molasses flows through the perforations of the basket filtering screens 535, 540 and basket 530 as it is subjected to increasing centrifugal force of rotation. The sugar crystals remain on the walls of the basket assembly 500 and move to the top of the basket assembly 500 where they are discharged over the lip into sugar discharge passageway 610 and ultimately discharged out of sugar discharge outlet 630. The labyrinth 625 of the centrifuge 605 guides the liquid molasses that has been separated to the molasses discharge outlet 615. The centrifuge process may be performed at a massecuite temperature from about 50° C. to about 80° C. and/or with a massecuite having a viscosity from about 50,000 centipoises to about 100,000 centipoises.

The massecuite feed may be delivered into basket assembly 500 from a storage or supply tank (not pictured) or may come directly from a prior sugar processing step, e.g., crystallization. The feed flows into the basket assembly 500 through the massecuite center feed pipe 400 to a feed opening 130 in the screen clamp 100.

The vertical centrifuge massecuite feed pipe 400 can deliver a homogeneous massecuite feed, which by gravity and centrifugal force, forces the massecuite down and out evenly through to the bottom of the basket assembly 500 as it rotates. The massecuite center feed pipe 400 may also have a feed water pipe 635 configured to deliver low viscosity fluids, e.g., feed water, surfactants, partially diluted molasses or a combination thereof to the massecuite center feed pipe 400 for mixing with the massecuite feed. As used herein "low viscosity fluids" means fluids with a viscosity that is at least less than the viscosity of the massecuite feed. The addition of these low viscosity fluids can reduce the massecuite viscosity. Specifically, the addition of surfactants can reduce the surface tension of the massecuite and facilitate the separation of sugar crystals from the liquid molasses, i.e., purging. The total amount of low viscosity fluids added may range from about 0% to about 8% by weight of massecuite. In another example, the total amount of low viscosity fluids added may also range from about 0% to about 6% by weight of massecuite.

The massecuite center feed pipe 400 may further comprise a steam jacket 640. Steam may enter the steam jacket 640 through a steam inlet, which optionally is regulated through a control valve. The steam jacket 640 may work to increase the temperature of the massecuite fluid entering the centrifuge 605. Increasing the temperature of massecuite can reduce the massecuite viscosity, thereby improving the massecuite flow and separation of the sugar crystals. The temperature of the massecuite fluid may be measured using a temperature sensor and controlled by an automatic temperature controller, which throttles the control valve to admit the required amount of steam for providing and maintaining a desired temperature. Of course, the massecuite fluid temperature may be increased and/or maintained by other methods. For example, massecuite fluid temperature may be increased and/or maintained by indirect methods, such as, contact with a stationary or rotating heated surface.

While several devices and components thereof have been discussed in detail above, it should be understood that the components, features, configurations, and methods of using the devices discussed are not limited to the contexts provided above. In particular, components, features, configurations, and methods of use described in the context of one of the devices may be incorporated into any of the other devices. Furthermore, not limited to the further description provided below, additional and alternative suitable components, features, configurations, and methods of using the devices, as well as various ways in which the teachings herein may be combined and interchanged, will be apparent to those of ordinary skill in the art in view of the teachings herein.

Versions of the devices described above may be actuated mechanically or electromechanically (e.g., using one or more electrical motors, solenoids, etc.). However, other actuation modes may be suitable as well including but not limited to pneumatic and/or hydraulic actuation, etc. Various suitable ways in which such alternative forms of actuation may be provided in a device as described above will be apparent to those of ordinary skill in the art in view of the teachings herein.

Versions of the devices described above may have various types of construction. By way of example only, any of the devices described herein, or components thereof, may be constructed from suitable metals, ceramics, plastics, or combinations thereof. Various suitable ways in which these and other modifications to the construction of devices described herein may be carried out will be apparent to those of ordinary skill in the art in view of the teachings herein.

Having shown and described various versions in the present disclosure, further adaptations of the devices and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A screen clamp with integrated center feed comprising:

a) a feed cone having a base and sidewall, wherein a center of the base has a feed opening and the sidewall has one or more discharge openings; and b) an outer flange attached to and extending along a bottom edge of the feed cone, wherein the outer flange is configured to secure a basket filtering screen of a continuous centrifuge to a basket, wherein the screen clamp is configured to direct a massecuite feed entering the feed opening through the one or more discharge openings and onto the basket filtering screen.

2. The screen clamp of claim 1, wherein the screen clamp further comprises a channel formed between an inner side of the outer flange and an exterior side of the feed cone.

3. The screen clamp of claim 1, wherein the outer flange has an upper weir edge.

4. The screen clamp of claim 1, wherein the feed cone is frusto-conical in shape.

5. The screen clamp of claim 1, further comprising one or more fastener openings in the base.

6. The screen clamp of claim 5, wherein the one or more fastener openings are configured to permit the screen clamp to be fastened to a basket hub.

7. The screen clamp of claim 1, wherein the one or more discharge openings are formed along the bottom edge of the sidewall.

8. A continuous centrifuge comprising a centrifuge housing and a center feed arrangement disposed in the centrifuge housing, wherein the center feed arrangement comprises:

a basket hub;

a basket rotatable around a vertical axis and attached to the basket hub;

a basket filtering screen attached to the basket;

a screen clamp that fastens the basket filtering screen to the basket, the screen clamp comprising:

a feed cone having a base and at least one sidewall extending downwardly from the base, wherein a center of the base comprises at least one feed opening and the bottom of the sidewall comprise one or more discharge openings; and an outer flange attached to and extending along a bottom edge of the feed cone a center feed pipe positioned to feed massecuite to the center of rotation of the screening basket;

wherein the center feed arrangement is configured to direct a massecuite feed through the feed opening of the screen clamp and through the one or more discharge openings of the screen clamp to the screening basket.

9. The continuous centrifuge of claim 8, wherein the screen clamp further comprises one or more fastener openings in the base.

10. The continuous centrifuge of claim 9, wherein the one or more fastener openings are configured to permit the screen clamp to be fastened to the basket hub.

11. The continuous centrifuge of claim 8, wherein the screen clamp further comprises a channel formed between an inner side of the outer flange and an exterior side of the feed cone.

12. The continuous centrifuge of claim 8, wherein the outer flange has an upper weir edge.

13. The continuous centrifuge of claim 8, wherein the feed cone is frusto-conical in shape.

14. The continuous centrifuge of claim 8, wherein the one or more discharge openings are formed along the bottom edge of the sidewall.

* * * * *